United States Patent [19]

Simard

[11] 4,451,910

[45] May 29, 1984

[54] ULTRASONIC POSITION MONITOR FOR HV DISCONNECT SWITCH

[75] Inventor: Julien Simard, Brossard, Canada

[73] Assignee: Hydro-Quebec, Montreal, Canada

[21] Appl. No.: 351,152

[22] Filed: Feb. 22, 1982

[30] Foreign Application Priority Data

Dec. 24, 1981 [CA] Canada ..... 393193

[51] Int. Cl.[3] ..... G08B 21/00

[52] U.S. Cl. ..... 367/199; 340/644; 361/115

[58] Field of Search ..... 367/199, 117; 340/644; 361/115

[56] References Cited

U.S. PATENT DOCUMENTS 3,550,090 12/1970 Baker, Jr. et al. ..... 367/199

4,236,149 11/1980 Soyck ..... 340/644

4,358,810 11/1982 Wafer et al. ..... 340/644

*Primary Examiner*—Donald J. Yusko

*Attorney, Agent, or Firm*—Burns, Doane, Swecker & Mathis

[57] ABSTRACT

A signalling system to indicate the position of a disconnect switch used in an electric transmission line. The switch has at least one moving contact and at least one fixed contact. The system comprises two transmitters associated with the moving and fixed contacts to transmit at least one ultrasonic signal indicating the position of the moving contact with relation to the fixed contact of the disconnect switch. A receiver assembly receives the ultrasonic signal transmitted by the transmitters and generates an output signal representative of the position of the moving and fixed contacts.

15 Claims, 4 Drawing Figures

RECEIVER

ULTRASONIC POSITION MONITOR FOR HV DISCONNECT SWITCH

BACKGROUND OF THE INVENTION (a) Field of the Invention

The present invention relates to a signalling system associated with a disconnect switch utilized in a high-voltage distribution line and more particularly to a signalling system which indicates the relative position of a moving contact relative to a fixed contact of the switch.

(b) Description of Prior Art

All electric distribution and transport networks are provided with disconnect switches to provide a means of connecting or disconnecting power from the lines or power apparatus connected thereto. These disconnect switches usually comprise a moving blade which constitutes a moving contact and which is rotated from a pivot point by a motor-driven mechanism. The switch also has a jaw provided with contact fingers which are capable of being displaced away from one another and between which the blade of the disconnect switch is positioned. By turning the blade axially the fingers are displaced and biased against the blade to provide a good closed contact. It is important to obtain a reliable signal which indicates the exact position of the various contacts of the disconnect switch in order to prevent switching errors which may prove costly. Such signal information also makes it possible to reliably automate the switching of the entire distribution network.

Up to now, the positions of the contact elements of the disconnect switches have been ascertained by sensing the mechanism which displaces the moving contact blade, which mechanism is used to close or open the switch. To date, such signals have been obtained by microswitches associated with the motorized mechanical connections of the moving contact. However, the interconnecting drive mechanism between the drive motor and the moving contact blade have many flexible connections and are sometimes inaccurate in their operation and therefore could cause an inaccurate closure of the moving contact, although the microswitches would indicate that the contact is properly closed. As such errors could cause the destruction of the contacts when a strong current passes through the disconnect switch, in certain cases it is necessary to make a visual inspection of the disconnect switch to ascertain the position of its contacts. Accordingly, presently known signalling systems are not totally reliable as to the information which they provide and prevent their use in an automatic system as often a visual inspection of the disconnect switch would be required.

SUMMARY OF THE INVENTION

It is therefore a feature of the present invention to provide a signalling system which substantially overcomes all of the above-mentioned disadvantages and which is capable of providing reliable signals indicating the relative position of each of the contacts of the disconnect switch, whether the motorized drive be single-phase or three-phase.

Another feature of the present invention is to provide a signalling system capable of accurately indicating the position of the moving contact in a disconnect switch, that being either open, closed or inbetween.

Another feature of the present invention is to provide a signalling system which is easily and quickly installed and which requires standard type equipment for its installation and which is adaptable to the majority of existing disconnect switches.

According to the above features, from a broad aspect, the present invention provides a signalling system for use with an electric disconnect switch which comprises at least one moving contact and at least one fixed contact. The signalling system comprises a transmission system coupled to the fixed contact of the disconnect switch for transmitting at least one ultrasonic signal indicative of the relative position of the moving contact relative to the fixed contact. A receiving system receives the transmitted signal and generates an output signal indicative of the position of the moving contact with respect to the fixed contact.

In a preferred embodiment of the present invention, the signalling system is adapted to a disconnect switch having at least one moving contact blade and at least one contact finger. The transmission system has at least one ultrasonic transmitter associated with the contact finger to transmit an ultrasonic signal when the finger is displaced by a movement of the contact blade. A receiver receives the ultrasonic signal transmitted by the transmitter and a decoder network associated with the receiver generates an output signal which corresponds to a predetermined position of the contact finger dependent on the blade position to indicate that the disconnect switch is closed or not closed.

In a still further preferred embodiment, the transmitter utilizes mechanical devices to generate two distinct ultrasonic signals when the mechanical transmitting device is activated by the movement of the contact finger through a mechanical connection in the form of a control cable. The frequency of each of the ultrasonic signals corresponds respectively to (i) the displacement of the contact by the contact blade being positioned to a closed position, or (ii) the release of the contact finger resulting from the opening of the disconnect switch with the moving contact blade moving out of engagement with the contact finger. Furthermore, the receiver is provided with reflectors which direct the ultrasonic wave signals to a circuit which transforms these wave signals into electrical signals. These electrical signals are representative of the specific frequencies and they are then decoded, to activate a specific relay to generate a signal indicative of the position of the moving contact with relation to the displaceable fixed contact.

BRIEF DESCRIPTION OF THE DRAWINGS

A preferred embodiment of the present invention will now be described with reference to the example thereof illustrated by the accompanying drawings, in which:

FIG. 4 shows the mechanical construction of the receiver.

DESCRIPTION OF PREFERRED EMBODIMENTS

Figure 1:
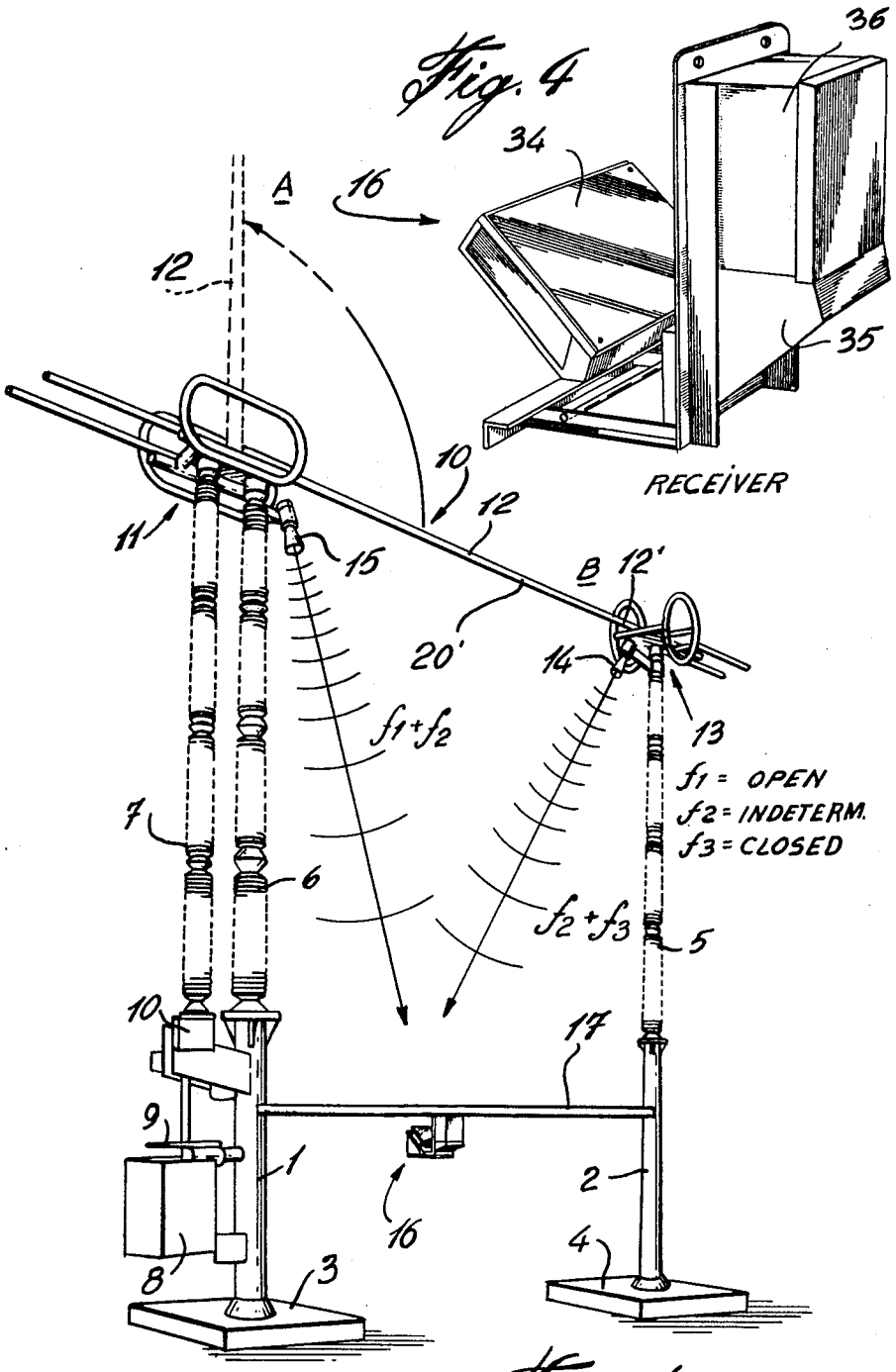
FIG. 1 is a perspective view illustrating schematically the mounting of a disconnect switch utilizing the signalling system of the present invention.
Figure 2:
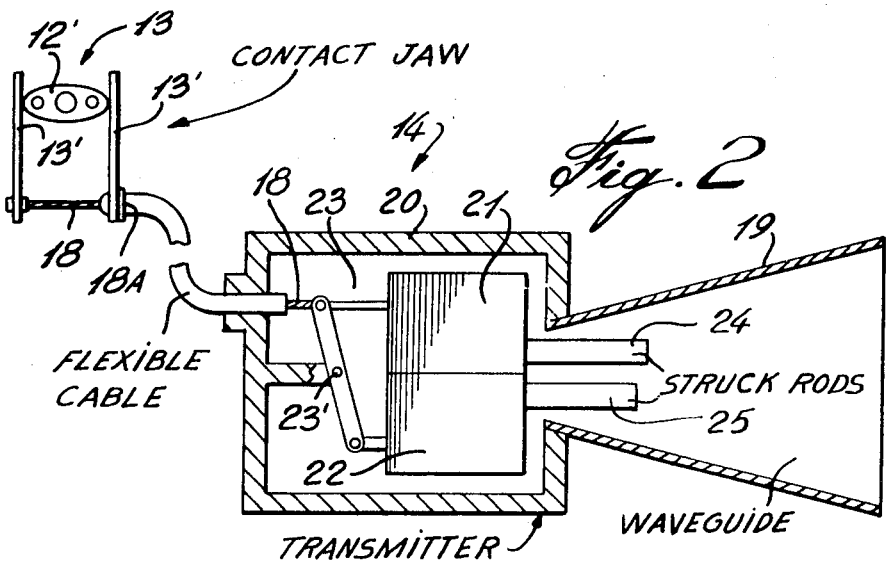
FIG. 2 is a simplified section view showing the various components of the transmitter with connection to the contact fingers of the disconnect switch.

In a three-phase electrical transmission system, each phase is connected, at a strategic point along the network, to a high-voltage disconnect switch 10 of the type as shown in FIG. 1. As shown in this figure, the disconnect switch comprises generally two metal support structures 1 and 2 secured respectively on a concrete base 3 and 4. The metal structures 1 and 2 may or may not be interconnected to each other. The metal structure 2 supports a column of porcelain insulators 5, while the metal structure 1 supports two columns of insulators 6 and 7. The insulating columns 5 and 6 are immovably secured to their respective metal structures while the insulating column 7 can be rotated axially by a motorized mechanism 8 via a drive wheel 9 and a drive train 10. The rotation of the column 7 causes the contact blade 12 to pivot from a closed position "B" to an open position "A". The drive also causes the blade 12 to axially rotate, when positioned between the contact fingers 13 and 13' of fixed contact 13 (see FIG. 2). This axial rotation is imparted via the pivoting and rotating mechanism 11, which construction is not shown herein in detail but is well known to a person skilled in the art. When the moving contact blade 12 is in position "B", the end portion 12' of the blade positions itself between contact fingers 13' of the fixed contact jaw 13, as shown in FIG. 2. The fixed contact is provided with at least one contact finger 13', which is displaceably or flexibly mounted to be displaced by the blade end. The contact blade 12 has at least the end portion 12' thereof usually constructed as an oval cross-section blade and its width usually slightly exceeds the distance between the contact fingers 13' when these are at their rest position, whereby when the contact blade is inserted between the contact fingers it will cause a contact but the actual rotation of the blade will ensure the contact by causing the fingers 13 to separate and be biased against the blade by applying constant pressure against the contact blade 12. When the blade 12 is in open position "A", the contact fingers 13' re-assume their initial position whereby the spacing therebetween is slightly less than the width of the contact blade end portion 12'. It can be seen that the respective spacing between the fingers 13' varies depending on whether the disconnect switch is engaged or disengaged. Thus, the signalling system of the present invention detects the position of the fingers whether they are closely spaced or spread apart by the axial rotation of the blade therebetween.

The signalling system comprises generally a transmitter system which is constituted by a first ultrasonic transmitter 14, secured adjacent the top end of the insulating column 5, and a second ultrasonic transmitter 15 secured adjacent the top end of the insulating column 6. Two distinct ultrasonic signals transmitted by the transmitter 14 provide an indication of the closed or undeterminated condition of the disconnect switch. That is to say, the blade 12 is in position between the fingers 13' or at an unknown position outside these fingers. The emitter 15 transmits an ultrasonic signal which is representative of the open position (position "A") of the blade 12, or any other position of the blade between positions "A" and "B". The signals transmitted by the transmitters 14 and 15 are directed towards a receiver 16 which is herein shown as secured on a transversal beam 17 connected between both support structures 1 and 2. The receiver 16 also comprises a decoding network that converts the ultrasonic signals received into corresponding electric signals which generate an output signal to a control center (not shown) in order to indicate that the disconnect switch is open or closed or that the contact blade 12 is at an indeterminate position between positions "A" and "B".

Referring more specifically to FIG. 2, this drawing illustrates schematically the elements found in the ultrasonic transmitters 14 and 15. Herein shown is transmitter 14 which is connected to the fingers 13' of the fixed contact 13 by means of a flexible cable 18 having a protective covering thereover. Each transmitter 14 and 15 is provided with such a cable, which is preferably a stainless steel cable. The transmitters are housed within a sealed housing 20 which contains two pulsing devices and a wave guide horn 19 which is secured above the periphery of an opening in the housing 20. Each pulsing device is provided with a trigger circuit 21 and 22, respectively, which are associated with a respective struck-rod 24 and 25. Each trigger circuit 21 and 22 is activated in a distinct manner by a displaceable rocking lever 23 pivotally secured at 23'. When triggered, each of the struck-rods 24 and 25 generates an ultrasonic signal of different frequencies one from the other and selected in the frequency range generally between 35 and 45 kHz.

The functioning of the transmitter will now be described with reference to the illustration in FIG. 2. As shown, the flexible cable 18 is connected at a free end to one of the contact fingers 13' of the jaw. A fastener 18*a* connects the cable cover to the other of the contact fingers 13'. As shown in FIG. 2, the fingers are shown separated from one another by means of the contact blade 12'. Accordingly, the disconnect switch is closed. This separation of the fingers 13' causes the cable 18 to be pulled out, thus activating the trigger circuit 22, causing the struck-rod 25 to generate an ultrasonic signal indicative of a closed switch condition. When the blade is actually rotated before disconnection from the jaw 13, the contact fingers 13' are moved closer together thus causing disconnection of the trigger circuit 22 and activating the trigger circuit 21, causing the struck-rod 24 to send a signal indicative that the moving contact blade 12' is in an indefinite position.

As previously noted, the ultrasonic frequencies generated by the struck-rods are different from one another. As far as the other transmitter 15 is concerned, the free end of its cable 18 (not shown) is connected to the pivoting and rotating mechanism to cause a signal to be generated when the blade is at position "A". The operation of the transmitter 15 is essentially the same as that of the transmitter 14, with the exception that one of the two frequencies is different from those of the transmitter 14. A first wave signal transmitted by the transmitter 15 indicates that the blade 12 is at an intermediate or indeterminate position between the positions "A" and "B", while the other wave signal indicates that the disconnect switch is entirely open and that the blade is at its position "A". Each ultrasonic signal emitted by either of the transmitters 14 or 15 is transmitted during a period of approximately one second and directed at the receiver 16.

Figure 3:
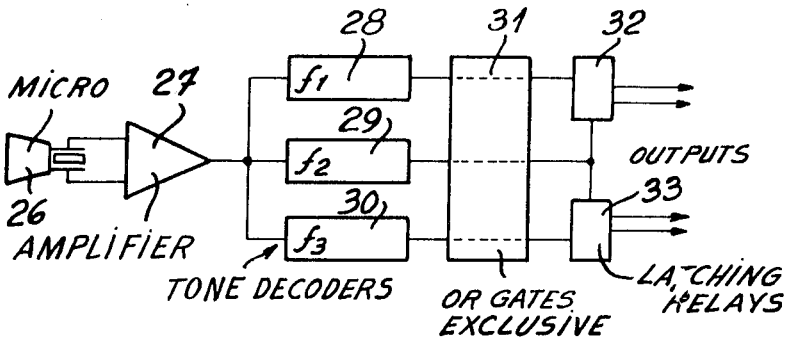
FIG. 3 is a block diagram showing the receiver circuit.

Referring to FIG. 3, there is shown in block diagram form, the construction of the receiver whose function is to identify each of the frequencies received from the transmitters 14 and 15. The receiver includes a microphone input device 26 which is sensitive to ultrasonic frequencies transmitted by the transmitters 14 and 15. This microphone transforms each of the ultrasonic signals generated by the struck-rods to an analogous voltage signal. The signal is then amplified by means of the amplifier 27. The amplified signal is then fed to tone decoders 28, 29 and 30, each of which is synchronized to the frequencies of the transmitters 14 and 15. A logic circuit 31, constituted by OR gates, prevents the passage of unwanted signals. A time constant verifies the presence of the signal during a time period of at least one second, which corresponds to the transmission time of the ultrasonic signal of the transmitters. The logic circuit also activates one of the latching relays 32 or 33 associated with the corresponding one of the transmitters, to prevent the relays from being activated by parasitic signals. The latching relays provide an output signal which is fed to a control center to indicate the positions or state of the disconnect switch.

At the control center, it is foreseen that the output control signals may activate, for example, colored lights, i.e. red, yellow or green, indicating a specific condition of the disconnect switch. For example, the red light could signal to the operator that the disconnect switch is closed. Also, following a command signal to open the disconnect switch and at the moment that the blade is rotated to release the contact fingers 13' to move toward one another, the transmitter 14 is activated indicating that the blade is in an indeterminate position and this may be indicated on the control panel by the yellow lamp being lit. The yellow lamp would stay lit during the complete pivotal movement of the blade contact 12 between positions "B" and "A" and until the transmitter 15 signals that the blade has reached its vertical position "A". At that time, the green light would be activated and the yellow lamp would be extinguished.

At the moment of the closing of the disconnect switch, and as soon as the blade has started to rotate a few degrees, the other of the struck-rods of the transmitter 15 will transmit a signal stating that the blade has left position "A" and is in an indeterminate position thereby causing the yellow lamp to light. Again, this yellow lamp will stay on until the contact blade has been inserted within the contact 13 and rotated to separate the fingers 13' then causing the transmitter 14 to generate another signal indicative of the contact being closed and causing the red light to be activated and the yellow light to be extinguished. It is pointed out that if the blade, for any reason whatsoever, would be wrongly positioned in the jaw 13, or would not be rotated 90° from its initial position, the transmitter 14 would not provide an indication that the contact is closed and the yellow lamp would stay on indicating that the blade is still in an indeterminate position. If, on the other hand, the blade is over-rotated, then the red lamp would light momentarily as the blade reaches substantially its 90° rotation, and then be extinguished, with the yellow light being lit again.

FIG. 4 illustrates the manner in which the receiver is constructed. As herein shown, the receiver comprises two reflector surfaces 34 and 35 secured at an angle of at least 45° to one another to cause the transmitted signal to be reflected towards a third reflector (not shown) and being disposed at an angle of approximately 45° and located within the receiver housing 36. The reflectors 34 and 35 are coated with a Teflon (Registered Trade Mark) coating in order to prevent snow from accumulating thereon and which would dampen somewhat the ultrasonic signals. The housing 36 contains the electronic elements or circuits as shown in FIG. 3. The microphone is conveniently located within the housing behind a protective screening (not shown). This sealed housing also provides shielding from electrostatic or electromagnetic fields which could affect the operation of the electronic elements housed therein. The housing also contains the power supply for the various circuits.

It is within the ambit of the present invention to cover any obvious modifications of the example of the preferred embodiment described herein, provided such modifications fall within the scope of the appended claims.

I claim:

1. A signalling system for use with an electric disconnect switch having at least one movable contact and at least one fixed contact, the said system comprising a transmission system coupled to said fixed contact of said disconnect switch for the transmission of at least one ultrasonic signal indicative of the relative position of the movable contact with relation to the said fixed contact, and a receiver system for receiving said at least one ultrasonic signal transmitted by said transmission system, said receiver generating an output signal representative of the relative position of said movable contact with respect to said fixed contact.

2. A signalling system as claimed in claim 1, wherein said transmission system comprises mechanical transmission means for the transmission of said ultrasonic signal.

3. A signalling system as claimed in claim 2, wherein the said fixed contact of the disconnect switch has at least one flexible contact finger capable of being displaced by a pressure exerted thereon by said movable contact, and wherein the said mechanical transmission means includes a detection means to detect the said movement of said flexible contact finger.

4. A signalling system as claimed in claim 3, wherein the said mechanical transmission means comprises an ultrasonic frequency generating device operable by the said detection means to detect the movement of said contact finger.

5. A signalling system as claimed in claim 4, wherein the said mechanical transmission means comprises a trigger circuit operable by the said detection means, and a struck-rod activated by the said trigger circuit to generate an ultrasonic signal of a predetermined frequency.

6. A signalling system as claimed in claim 5, wherein the said trigger circuit and the said struck-rod are contained in a sealed housing provided with an opening to which a wave guide horn is connected to directionally transmit said ultrasonic signal.

7. A signalling system as claimed in claim 1, wherein the said receiver system comprises a converter device to transform the ultrasonic signal into an electric signal, and means to transmit the said electrical signal to a control center.

8. A signalling system as claimed in claim 7, wherein the said receiver system comprises at least one reflector element to divert the said ultrasonic signal towards the said converter circuit.

9. A signalling system as claimed in claim 1, wherein the said transmission system comprises two mechanical transmitting devices, one of said transmitting devices being connected to the fixed contact and being capable of generating a first ultrasonic signal of a known frequency, the other of said transmitting devices being capable of generating a second ultrasonic signal of a different frequency than the frequency of the said first signal, and wherein said receiver system has a detector capable of detecting the frequencies of said first and second ultrasonic signals and for generating electric signals of frequencies corresponding to the said first and second signals, and decoding means to decode said electric signals and to feed a selection circuit associated with respective ones of said electric signals and generate said output signal representative of the position of said movable contact relative to said fixed contact.

10. A signalling system for use with an electric disconnect switch having at least one movable blade contact and at least one finger contact, said system comprising a transmission system capable of transmitting at least one ultrasonic signal, said transmission system being connected to said fixed contact finger of said disconnect switch to transmit an ultrasonic signal of a predetermined frequency when said contact finger is displaced by a predetermined movement of said movable contact blade, a receiver system capable of receiving said electronic signal transmitted by said transmission system, and a decoder circuit associated with said receiver and capable of generating an output signal corresponding to a predetermined position of said movable finger contact and of a position of said blade to provide a signal indicative that the said disconnect switch is connected or disconnected.

11. A signalling system, as claimed in claim 10, wherein said transmission system comprises a first mechanical transmitter device for the transmission of a first ultrasonic signal having a predetermined frequency which is indicative of the displacement of the said contact finger in a given direction, and a second mechanical transmitter device capable of transmitting a second ultrasonic signal of a different known frequency indicative of a displacement of the contact finger in an opposed direction to said first direction, said first and second mechanical transmitter devices being activated at different times by means of a mechanical lever device which is mechanically coupled to the said contact finger.

12. A signalling system, as claimed in claim 10, comprising a second transmission system connected to the said displaceable contact blade and generating at least one ultrasonic signal corresponding to at least one position of said blade contact of said disconnect switch.

13. A signalling system, as claimed in claim 12, wherein said second transmission system comprises at least one mechanical transmitter device to transmit the said ultrasonic signal at a predetermined frequency, the said mechanical transmitter device being connected to a blade pivoting mechanism by a mechanical connection means.

14. A signalling system, as claimed in claim 11 or 13, wherein said mechanical transmission means for the transmission of ultrasonic signals are identical and each comprises a trigger circuit to activate a respective struck-rod.

15. A signalling system, as claimed in claim 10, wherein the said transmission system comprises two transmitters, each transmitter generating two ultrasonic signals of different frequencies one from the other and also of at least two frequencies different from the other of said two transmitters.

* * * * *